US005931596A

United States Patent [19]

Javier

[11] Patent Number: 5,931,596

[45] Date of Patent: Aug. 3, 1999

[54] CLEANABLE FLUID DISPENSING BRUSH

[76] Inventor: Lenor Javier, 2339 Hundson Ter. Apt. B-5, Fort Lee, N.J. 07024

[21] Appl. No.: 09/003,789

[22] Filed: Jan. 7, 1998

[51] Int. Cl.[6] ..... A46B 11/02

[52] U.S. Cl. ..... 401/268; 401/287; 401/289

[58] Field of Search ..... 401/268, 271, 401/286, 287, 289, 291, 183

[56] References Cited

U.S. PATENT DOCUMENTS

| | | | |
|---|---|---|---|
| 1,047,729 | 12/1912 | Beardsley | 401/287 |
| 1,191,578 | 7/1916 | Englund | 401/289 |
| 1,389,665 | 9/1921 | James | 401/289 |
| 1,521,783 | 1/1925 | Mendoza . | |
| 1,563,190 | 11/1925 | House . | |
| 1,797,946 | 3/1931 | Eichel | 401/287 |
| 2,053,145 | 9/1936 | Hamel . | |
| 3,536,410 | 10/1970 | Wargoe | 401/268 |
| 3,589,823 | 6/1971 | Hendrickson | 401/287 |
| 4,265,560 | 5/1981 | Spica | 401/183 |
| 4,588,089 | 5/1986 | Yanz, Jr. et al. | 401/268 |
| 5,033,898 | 7/1991 | Williams | 401/287 |
| 5,062,728 | 11/1991 | Kuo . | |
| 5,114,256 | 5/1992 | Lin | 401/289 |
| 5,123,765 | 6/1992 | O'Connell et al. | 401/268 |

FOREIGN PATENT DOCUMENTS

| | | | |
|---|---|---|---|
| 490841 | 11/1936 | United Kingdom | 401/287 |

*Primary Examiner*—Charles R. Eloshway
*Attorney, Agent, or Firm*—Terrance L. Siemens

[57] ABSTRACT

A brush having a passage for conducting a fluid to the bristles. The brush has a handle enclosing a passage extending along the entire length and opening to one end of the handle. A head bearing bristles is attached to the proximal end of the handle. The passage of the handle extends into the head along the extent of the bristles. That surface of the brush bearing bristles has a plurality of holes communicating with the passage. A removable cover is located on the head behind the surface bearing bristles. This cover is snap fit to the head, retained by friction, and has a tab enabling engagement by fingernail. The cover is dimensioned and configured to expose all holes for dispensing fluid to direct access for cleaning. The handle has at its distal end a threaded socket for threading to a tube of toothpaste.

3 Claims, 1 Drawing Sheet

CLEANABLE FLUID DISPENSING BRUSH

BACKGROUND OF THE INVENTION

1. Field of the Invention

The present invention relates to brushes of the type dispensing fluids amidst the bristles. More particularly, the novel brush has a panel which can be moved to reveal a channel leading to the bristles, so that the channel can be cleaned. While an important application of the invention is dispensing of toothpaste from a toothbrush, any brush which is customarily employed with a fluid may be improved by the invention.

2. Description of the Prior Art

Many tasks performed with brushes require that the brush utilize a fluid which is dispensed in controlled quantities. An example is a toothbrush which dispenses toothpaste at the bristles, the toothpaste being delivered under pressure through the handle. This concept is well known, being exemplified by U.S. Pat. No. 1,521,783, issued to Arnulfo Mendoza on Jan. 6, 1925, U.S. Pat. No. 1,563,190, issued to Charles H. House on Nov. 24, 1925, U.S. Pat. No. 2,053,145, issued to David W. Hamel on Sep. 1, 1936, and U.S. Pat. No. 5,062,728, issued to Youti Kuo on Nov. 5, 1991.

In each case, the subject brush has a passage formed in the handle or stem leading to the brush. Dentifrice paste is forced through the passage and is discharged at the bristles of the brush. The device of House illustrates threaded connection of a toothpaste tube to a brush. The devices of Mendoza and Kuo feature removable bristle bases. By contrast with these prior art brushes, the present invention has a plurality of dispensing holes formed in the head of the brush, for avoiding concentration of ejected paste at one point. Also, the present invention includes a removable panel which simultaneously exposes all dispensing holes, as well as greatly reducing concealed length of the passage.

None of the above inventions and patents, taken either singly or in combination, is seen to describe the instant invention as claimed.

SUMMARY OF THE INVENTION

The present invention sets forth a brush which improves over the prior art in two ways. The novel brush includes a head bearing bristles and an elongated handle. One improvement is that the head of the brush is provided with a plurality of discharge holes disposed about the entire area of the head bearing bristles. This characteristic causes even discharge of paste about the area of the bristles. The second improvement is provision of a removable cover which exposes the rear of the head behind the area bearing bristles. The cover snap fits to the back of the head for ready removal, while offering secure retention. The cover has a tab enabling engagement by fingernail or the like for ease of prying the cover from a channel which frictionally retains the cover. Therefore, the cover is removed and reinstalled manually, without tools.

The discharge holes are considerably smaller in area than the channel formed in the handle for conducting paste from the supply to the head. The discharge holes are thus more prone to obstruction from residual paste, this being particularly noticeable when the paste dries. However, removal of the cover both exposes a significant area of the channel conducting paste for cleaning, and also exposes every hole to direct access for cleaning under running warm water while gently tapping it on a hard surface.

The handle terminates in a female socket bearing threads preferably corresponding to those of caps conventionally provided to close toothpaste tubes. The tube may therefore be threaded to the socket. When the tube is connected to the novel brush and squeezed, paste is forced through the channel and is discharged at the bristles. Thus, the novel brush both enables ready supply of paste under manual force, and also enables thorough cleaning.

Accordingly, it is a principal object of the invention to provide a brush capable of dispensing a fluid at the bristles.

It is another object of the invention to provide a plurality of discharge holes at the bristles for discharging fluid under force evenly about the bristles.

It is a further object of the invention to provide direct access to the discharge holes to enable effective cleaning.

Still another object of the invention is to provide access to a significant portion of the channel conducting the paste from the supply thereof.

An additional object of the invention is to enable ready connection of a toothpaste tube to the novel brush.

It is again an object of the invention that no tools be required to remove and replace the cover covering the discharge holes.

Yet another object of the invention is to provide a threaded socket cooperating with threads of a toothpaste tube.

It is an object of the invention to provide improved elements and arrangements thereof in an apparatus for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Various other objects, features, and attendant advantages of the present invention will become more fully appreciated as the same becomes better understood when considered in conjunction with the accompanying drawings, in which like reference characters designate the same or similar parts throughout the several views, and wherein.

DETAILED DESCRIPTION OF THE PREFERRED EMBODIMENTS

Figure 1:
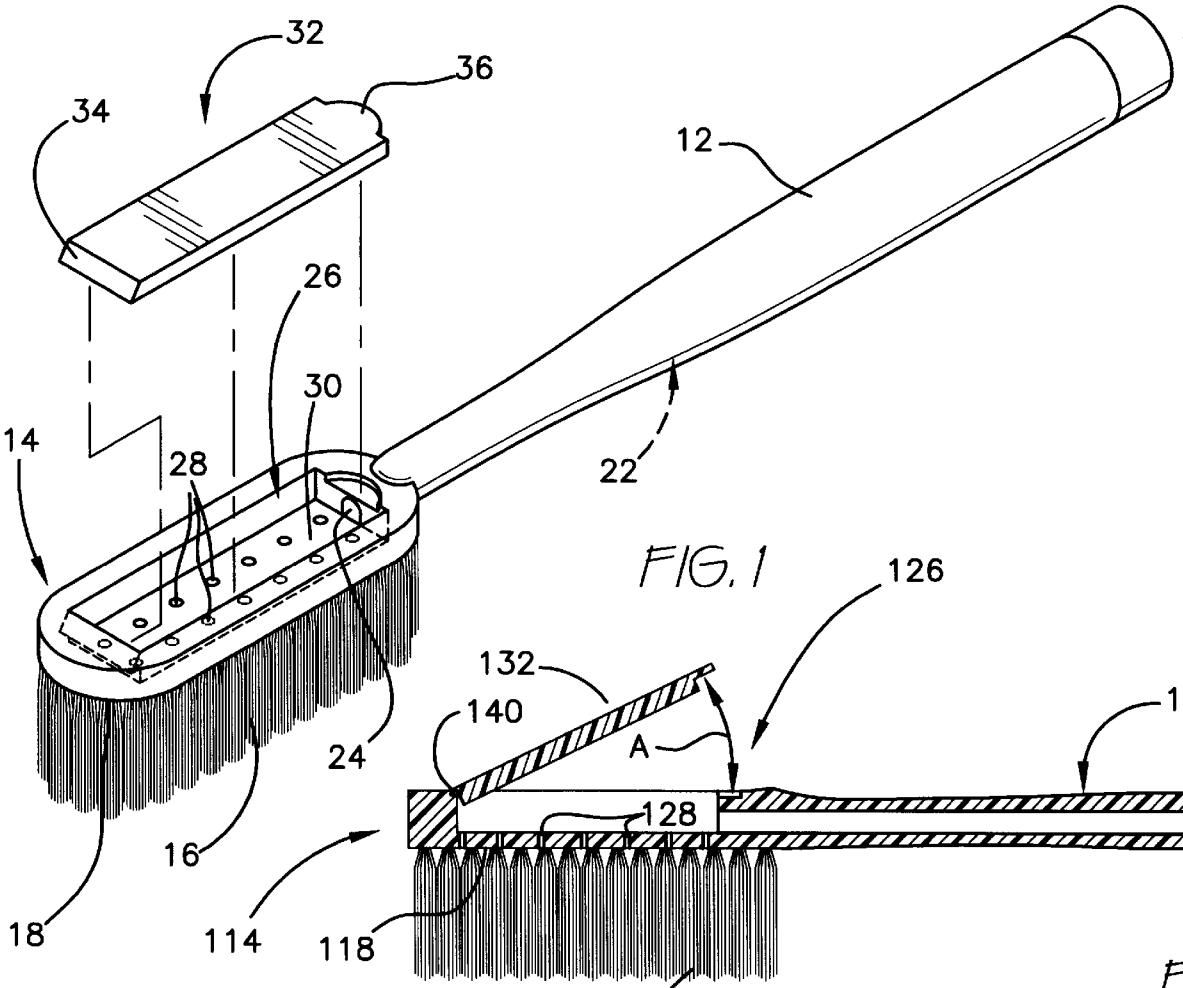
FIG. 1 is a perspective view of one embodiment of the invention.

Turning now to FIG. 1 of the drawings, novel brush 10 is seen to comprise a handle 12 and a head 14. Head 14 has bristles 16 affixed in any suitable manner, such as by embedding, to a bristle bearing surface 18. Handle 12 is suitably elongated so that it can be comfortably grasped by hand. Brush 10 dispenses fluid, such as toothpaste contained in a tube (not shown). The tube is threaded into a female socket 38 formed at the distal end of hollow handle 12. Socket 38 opens to a passage 22 disposed centrally inside and extending entirely through handle 12.

Passage 22 opens at 24 at the proximal end of handle 12 to a chamber 26. Chamber 26 extends passage 22 from handle 12 along the rear of surface 18 to a point near the end of head 14. This configuration allows toothpaste to be conducted from the distal end of handle 12 to each one of a plurality of discharge openings 28. Openings 28 are located periodically about a rear surface 30 of head 14. Surface 30 forms the floor of chamber 26, openings 28 communicating between surfaces 18 and 30. Head 14 is thus adapted to dispense fluids at bristles 16. It would be possible in some applications that only one opening 28 be present. However, more even discharge of fluid onto bristles 16 is possible when a plurality of openings 28 are present in spaced apart relationship at surfaces 18 and 30.

Chamber 26 is closed by a cover 32 separate from head 14 and removable therefrom. Cover 32 is disposed spaced apart from surface 30, and is dimensioned and configured to reveal chamber 26 and hence passage 22 at a location behind bristle bearing surface 18 when removed. Walls defining chamber 26 are dimensioned and configured to be disposed in close cooperation with cover 32 so as to frictionally retain cover 32 to head 14. Cover 32 may include a ramp 34 or other projecting structure (not shown) to assist in engaging head 14 when installing cover 32 after removal. Cover 32 also includes a tab 36 which may be engaged by a fingernail to dislodge cover 32 from head 14 while removing cover 32 to expose chamber 26.

Brush 10 has a threaded female socket 38 formed at the distal end of handle 12 for receiving a tube of toothpaste. This arrangement enables a tube conventionally provided to supply toothpaste to be readily connected to brush 10, so that no internal or integral supply need be provided. The tube is threaded to socket 38, squeezed to dispense toothpaste, and subsequently removed from brush 10.

Figure 2:
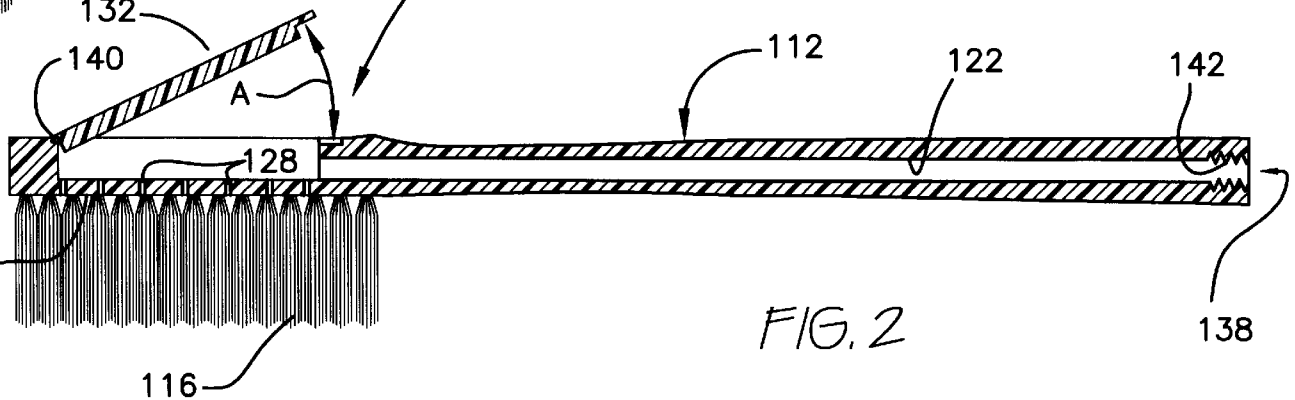
FIG. 2 is a side cross sectional view of a second embodiment of the invention.

FIG. 2 illustrates a second embodiment of the invention. Brush 110 generally has features and construction similar to those of brush 10, differing only in connection of cover 132, which is a counterpart of cover 32 of FIG. 1, to head 114, which is a counterpart of head 14 of FIG. 1. In the embodiment of FIG. 2, cover 132 is pivotally tethered to head 114 by a flexible hinge 140. As seen in FIG. 2, hinge 140 is integral with head 114 and with cover 132. Cover 132 can pivot with respect to head 114 about an arc indicated by arrow A. Hinge 140 supersedes engagement by interference seen in the embodiment of FIG. 1.

FIG. 2 illustrates continuous extent of passage 122 from socket 138 to chamber 126. Threads 142 of socket 138 are clearly shown in FIG. 2.

The embodiments of FIGS. 1 and 2 are generally similar. Elements identified by reference numerals bearing identical final two digits are identical between the two embodiments.

The present invention is susceptible to variations and modifications which may be introduced thereto without departing from the inventive concept. For example, hinge 140 of FIG. 2 may be located on a different edge of chamber 26 from that illustrated. The arrangement of chamber 26 or of the pattern of openings 28 may be varied to suit. Constituent material and precise configuration of chamber 26 (or 126) may be varied to yield resiliently in order to retain cover 32 (or 132) by friction. Alternatively, retention of cover 32 or 132 may be by interference fit, fastener, or any combination of attachment characteristics. Obviously, the present invention may be employed with fluent materials other than toothpaste.

It is to be understood that the present invention is not limited to the embodiments described above, but encompasses any and all embodiments within the scope of the following claims.

I claim:

1. A toothbrush having bristles and adapted to dispense toothpaste to said bristles, comprising:

an elongated, hollow handle having a proximal end and a passage disposed centrally inside said handle and extending entirely through said handle, said handle having a distal end and a threaded female socket located at said distal end, said female socket communicating with said passage and being configured to mate with a conventional male threaded toothpaste tube; and a head fixed at said proximal end of said handle, said head having a bristle bearing surface, bristles affixed to said bristle bearing surface, and a rear surface, said passage of said handle extending into said head, said head having a plurality of openings extending substantially along the entire said bristle bearing surface in a rectangular array, said openings communicating between said passage and said bristle bearing surface, said head further having a separate, removable cover disposed at said rear surface of said head opposite said openings, said removable cover dimensioned and configured to reveal the portion of said passage in said head behind said bristle bearing surface when removed said head having a flexible hinge connecting said cover to said head, wherein said hinge is integral with said head and said hinge, wherein, upon completion of brushing, said cover is removed and a cleaning fluid is supplied directly to said passage and said openings to remove residual toothpaste therefrom and prevent clogging of said openings and said passage.

2. The brush according to claim 1, further comprising passage walls disposed in close cooperation with said cover, said passage walls disposed to frictionally retain said cover to said head.

3. The brush according to claim 2, said cover having a tab projecting therefrom, for enabling ready engagement of said cover by fingernail.

* * * * *